US005149339A

United States Patent [19]

Collins, Jr.

[11] Patent Number: 5,149,339

[45] Date of Patent: Sep. 22, 1992

[54] ROTARY DEVICE FOR REMOVING PARTICULATES FROM A GAS STREAM

[75] Inventor: Earl R. Collins, Jr., La Canada, Calif.

[73] Assignee: California Institute of Technology, Pasadena, Calif.

[21] Appl. No.: 667,712

[22] Filed: Mar. 11, 1991

[51] Int. Cl.[5] ..... B03C 1/00

[52] U.S. Cl. ..... 55/6; 55/127; 55/152

[58] Field of Search ..... 55/127, 152, 6

[56] References Cited

U.S. PATENT DOCUMENTS

| | | | |
|---|---|---|---|
| 1,445,662 | 2/1923 | Bradley | 55/139 |
| 1,575,013 | 3/1926 | Slepian | 55/139 |
| 2,566,073 | 8/1951 | Streuber | 55/139 |
| 2,594,805 | 4/1952 | Rommel | 55/139 |
| 3,400,513 | 9/1968 | Boll | 55/103 |
| 3,493,109 | 2/1970 | Carta et al. | 209/11 |
| 3,736,727 | 6/1973 | Shriner | 55/103 |
| 3,783,588 | 1/1974 | Hudis | 55/126 |
| 3,820,306 | 6/1974 | Vincent | 55/123 |
| 3,907,520 | 9/1975 | Huang et al. | 55/4 |
| 4,093,430 | 6/1978 | Schwab et al. | 55/107 |
| 4,134,744 | 1/1979 | Peterson et al. | 55/118 |
| 4,229,187 | 10/1980 | Stockford et al. | 55/14 |
| 4,339,782 | 7/1982 | Yu et al. | 361/229 |
| 4,352,681 | 10/1982 | Dietz | 55/152 |
| 4,398,928 | 8/1983 | Kunsagi | 55/107 |
| 4,501,598 | 2/1985 | Long | 55/2 |
| 4,544,382 | 10/1985 | Taillet et al. | 55/107 |
| 4,588,423 | 5/1986 | Gilliagham et al. | 55/127 |
| 4,846,856 | 7/1989 | Burger et al. | 55/106 |
| 4,871,515 | 10/1989 | Reichle et al. | 422/174 |

*Primary Examiner*—Bernard Nozick
*Attorney, Agent, or Firm*—John J. Posta, Jr.

[57] ABSTRACT

A rotary particulate separator for removing particulates from a pressurized gas stream such as that emanating from a reactor vessel is disclosed which precharges the particles in the gas stream, and then utilizes the charge on the particles to induce them from the main flow path through an airblock and into the rotary particulate separator. The rotor of the rotary particulate separator has polarized plates which use a first charge opposite that on the charged particles to attract the particles as they enter the rotation chamber, and then use a second charge of the same polarity as the charge on the charged particles to release the particles into a control gas flow vortex which draws the particles radially inwardly into an exit aperture contained in the center of one of the rotor segments and out from the device. Pressure letdown devices are used to drop the pressure of both the control gas flow exiting the separator with the particles and the cleaned gas stream.

28 Claims, 6 Drawing Sheets

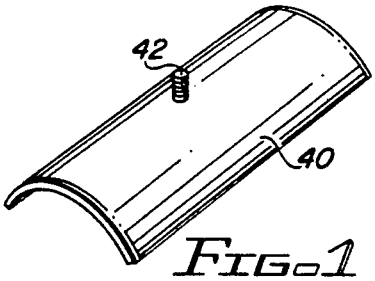
FIG. 1
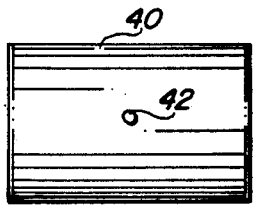
FIG. 2
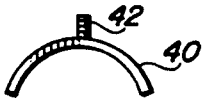
FIG. 3
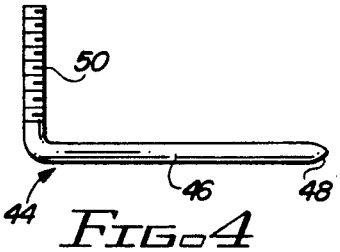
FIG. 4
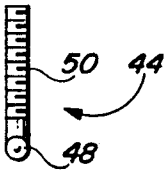
FIG. 5
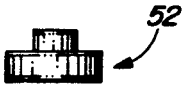
FIG. 6
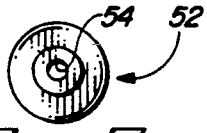
FIG. 7
FIG. 8
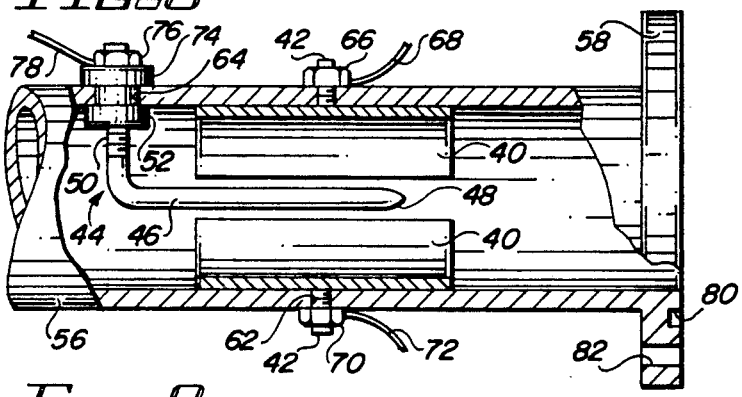
FIG. 9
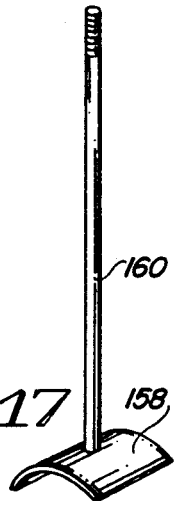
FIG. 17
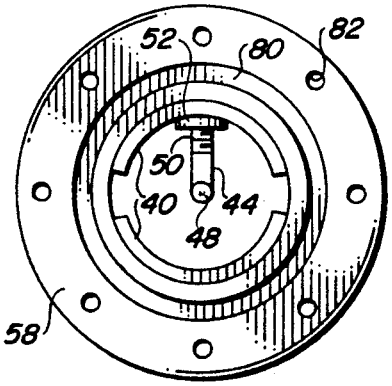
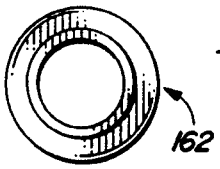
FIG. 19
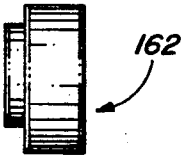
FIG. 20
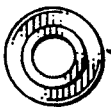
FIG. 21
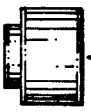
FIG. 22
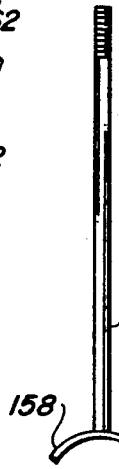
FIG. 18

FIG. 10
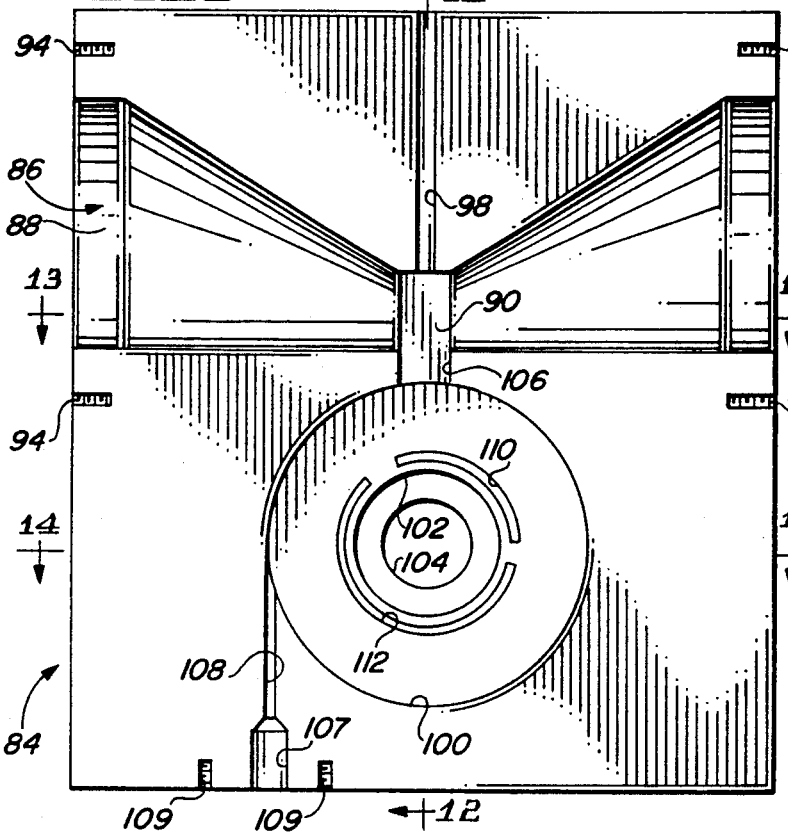
FIG. 11
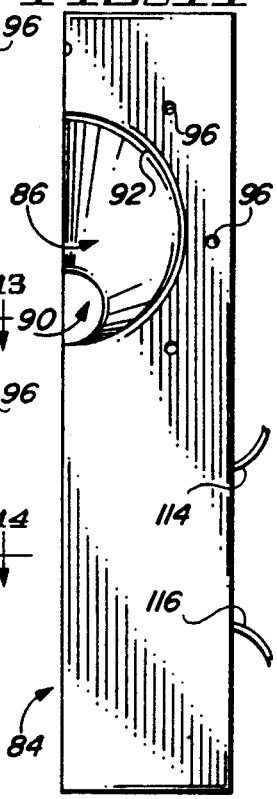
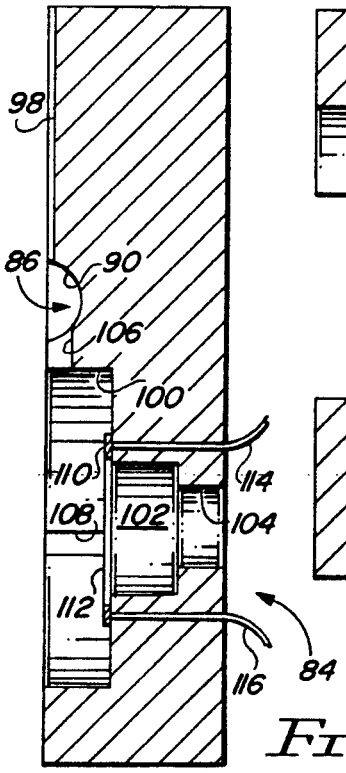
FIG. 12
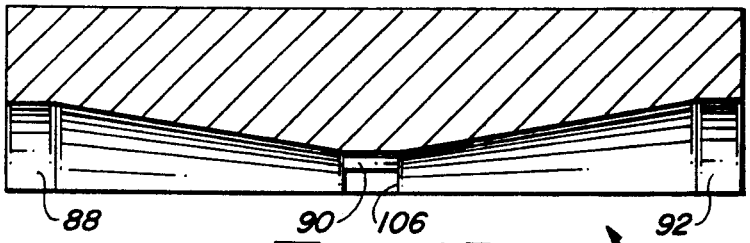
FIG. 13
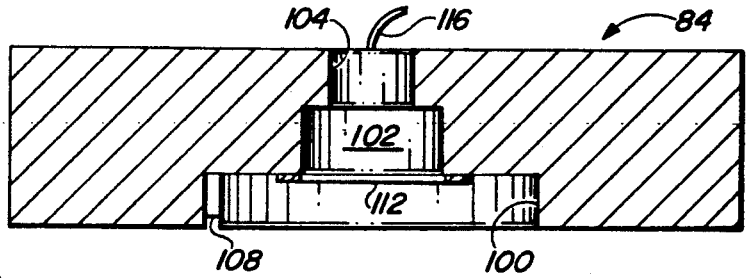
FIG. 14

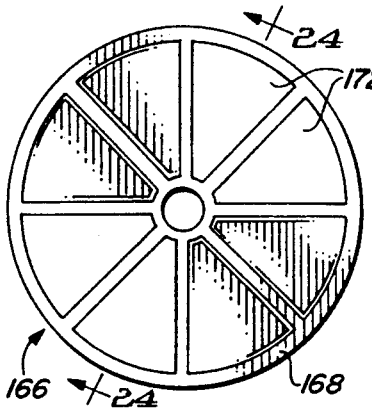
FIG. 23
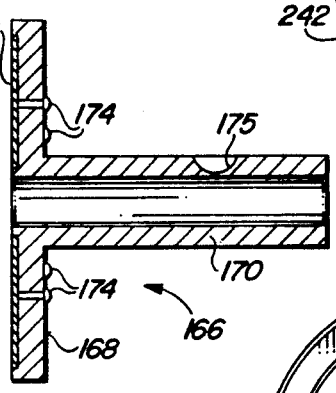
FIG. 24
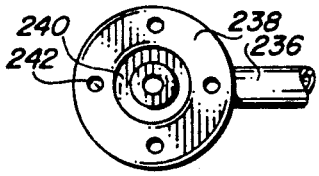
FIG. 32
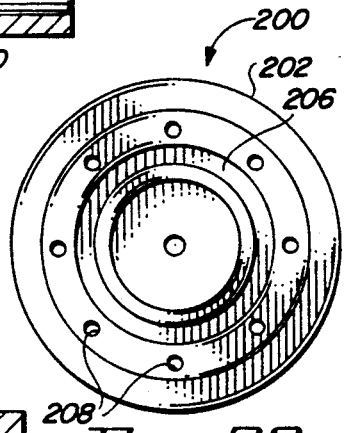
FIG. 29
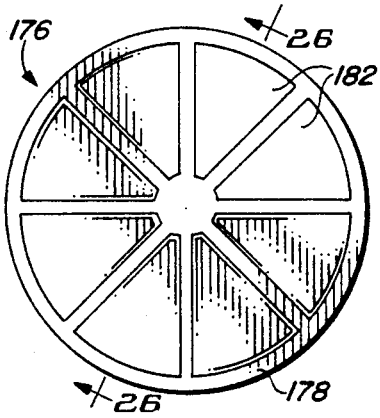
FIG. 25
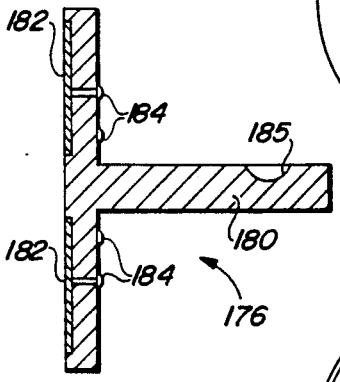
FIG. 26
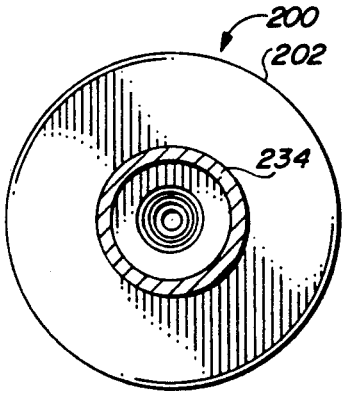
FIG. 30
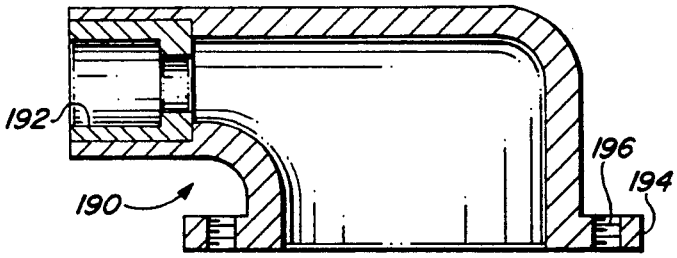
FIG. 27
FIG. 28
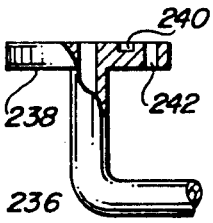
FIG. 31
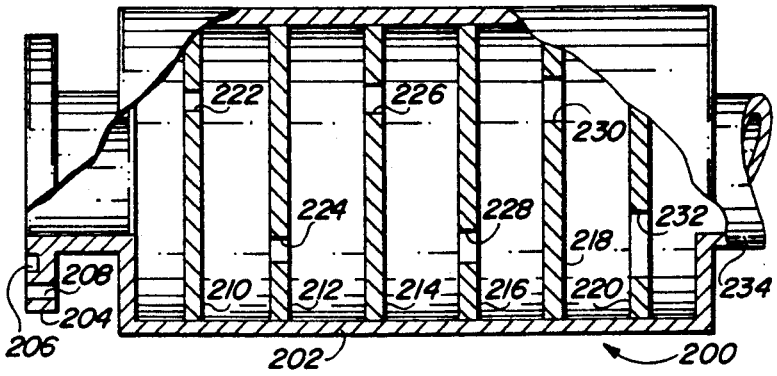

ROTARY DEVICE FOR REMOVING PARTICULATES FROM A GAS STREAM

ORIGIN OF THE INVENTION

The invention described herein was made in the performance of work under a NASA Contract, and is subject to the provisions of Public Law 96-517 (35 U.S.C. 202) in which the Contractor has elected to retain title.

BACKGROUND OF THE INVENTION

1. Field of the Invention

The present invention relates generally to a rotary particulate separator for removing particulates from a pressurized gas stream such as that emanating from a reactor vessel, and more particularly to a particulate separator which utilizes a charge placed on particles in the gas stream first to induce them from the main flow path into a vortex generator, and then to carry the charged particles with a rotor located in the vortex generator into a vortex generated by a control gas flow which draws the particles radially inwardly into an exit aperture and out from the device.

2. Description of Background Information

A wide variety of devices either utilize gas as a working fluid to remove particulates from an operating environment or produce a gaseous stream containing particulates which are released by an operating environment. In either case, a gas stream is produced by a multitude of different systems, and that gas stream must be cleaned to remove the particulates prior to discharging the gas stream into the environment. One particular example of such an operating environment which presents particular problems is that of a reactor vessel producing a high pressure gas stream containing particulates which must be removed and collected for proper disposal.

As might be expected, the art is replete with examples of devices for removing particulates from a gas stream. Most of the early particulate separators are mechanical filters having a barrier construction which allows gas to flow therethrough. Such mechanical filters are quite effective in removing particulates having a sufficiently large physical size so as to enable the mechanical filter to trap the particulates. However, in many systems in use today, including the reactor environment contemplated herein, particulates produced are too fine to become trapped in a mechanical filter unless the filter is sufficiently small, in which case the particulates tend to quickly clog the filter.

Particulates in the reactor environment contemplated herein have a typical diameter of approximately two to five microns, with the gas stream having a typical pressure of 300 to 400 PSI. The particulates must be removed from the high pressure gas stream, which emanates from the reactor vessel on a continuous basis, thereby necessitating continuous processing rather than batch processing. Given the particulate size of two to five microns, the settling rate is from 0.7 to 4.4 inches per second, as per Stoke's law.

A vast number of references exist which utilize various types of electrostatic precipitation. The simplest of these devices is the basic electrostatic precipitator which places a charge on particulates, and uses electrostatic force to collect them at a collection location in the device. Examples of such devices are found in U.S. Pat. No. 3,400,513, to Boll, in U.S. Pat. No. 3,820,306, to Vincent, and in U.S. Pat. No. 4,544,382, to Taillet et al.

The Boll patent has a gas stream ducted into and out of a housing, with particulates in the gas stream being charged upon entering the housing and collected by a precipitator. The Vincent device is made of a plurality of charged plates with dielectric plates (or grids) therebetween, with the dielectric plates receiving induced potentials and causing precipitation of particles. The Taillet et al. patent uses ion generators to produce space charges in an enclosure in which the gas stream containing particulates flows, thus initiating precipitation of the particulates.

The next step in increasing complexity of electrostatic precipitators involves the addition of a filter element to entrap particles drawn into the filter element by electrostatic force. Devices utilizing this type of construction are illustrated in U.S. Pat. No. 4,339,782, to Yu et al., in U.S. Pat. No. 4,501,598, to Long, and in U.S. Pat. No. 4,871,515, to Reichle et al.

The Yu et al. patent illustrates an ionizer utilized to charge particulates in a gas stream, with a charged filter element being used to electrostatically attract and contain particulates in the gas stream. The Long reference uses a filter element disposed in the gas flow, with portions of the filter medium fluttering to generate electrostatic charges to attract and remove particulates from the gas stream. The Reichle et al. patent uses a filter element containing "windshadow areas," which shield trapped particles from the gas stream to prevent them from reentering the gas stream once trapped in the filter by electrostatic separation.

An enhancement to electrostatic separation using a fixed filter is illustrated in U.S. Pat. No. 3,783,588, to Hudis, and in U.S. Pat. No. 4,229,187, to Stockford et al. In the Hudis patent, moving sheets of filter material are passed through a gas stream, with electrostatic charge being used to attract particulates to the sheets. The sheets may be cleaned when they are not contained in the gas stream. The Stockford et al. reference teaches the use of a filter media which develops an electrostatic charge in a dry, fast gas stream.

A more complex type of electrostatic precipitator is taught in U.S. Pat. No. 4,093,430, to Schwab et al., and in U.S. Pat. No. 4,846,430, to Burger et al. These devices charge particles in the gas stream and remove them in a wet process known as "scrubbing." The Schwab et al. reference uses a dense electrostatic field to charge particulates which may then be removed by a scrubber. The Burger et al. patent teaches dispersing scrubbing liquid into the gas stream and then ionizing the particulates and liquid droplets, which are removed by a high speed brush charged to attract the particulates and the droplets.

These devices discussed briefly above are all useful in their preferred environments, but are not acceptable for use with the reactor to remove the contaminated particulates in the high pressure gas stream leaving the reactor vessel. The high pressure, continuous flow characteristics of the reactor combined with the necessity for complete removal of the particulates present a situation the devices discussed above are not able to cope with in an acceptable manner.

To date, the only devices which have been even close to acceptable in particulate removal characteristics are centrifugal type devices rather than electrostatic filters. Even these devices have not been completely successful. Looking once again at the art for further variations, two additional references have been located, both of which combine centrifugal force with electrostatic attraction of particulates. These devices are illustrated in U.S. Pat. No. 4,134,744, to Peterson et al., and in U.S. Pat. No. 4,398,928, to Kunsagi.

The Peterson et al. device is designed for an industrial application, and has a disk with plural pie-shaped segments through which the gas stream is directed. Alternating segments of the disk are charged with opposite polarities, and dielectric fluid is supplied to the center of the disk. The disk is spun to flow the dielectric fluid radially outwardly, and the charges on the segments of the disk attract particulates in the gas stream. The dielectric fluid thus washes particulates attracted to the disk outwardly, where the charge is neutralized and the fluid, together with the particulates, is collected.

While the Peterson et al. device represents an interesting approach, it simply is not suitable for the high pressure reactor application contemplated herein. The particulates in the gas stream are not precharged, and since they are very small, they may well flow through the disk and not be removed. In addition, the use of the dielectric fluid creates an additional waste disposal problem, exacerbating the situation instead of improving it.

Finally, the Kunsagi reference teaches a centrifugal separator using a nozzle directed tangentially to impart a high rotational velocity to the gas stream in a chamber. Electrical charges carried on aerosol charge carriers are used to charge small particles, which are then attracted to the outer walls, where they are carried away by the scavenging flow of the larger particles. The Kunsagi reference is designed for removal of particulates generated in combustion of coal, which are much larger than the particulates of the application contemplated herein. Thus, none of these references suggest a device or method for accomplishing the removal of particulates from a reactor gas stream in a suitable manner.

It is accordingly the primary objective of the present invention that it operate to remove substantially all of the particulates contained in the gas stream emanating from a reactor vessel. Thus, the particulate separator of the present invention must be operable on a continuous, high pressure gas stream including particulates to remove the particulates as efficiently as possible. The particulate separator must also be operable on the small particulates typically contained in a reactor vessel gas stream, which range from approximately two to five microns, and which have small settling rates.

It is a further objective of the present invention that it operate in a manner not requiring a scrubbing fluid, the use of which would further exacerbate the problem of substance disposal. In addition, the solution to the problems enumerated above should not involve the use of a filter medium, which may become clogged or which may require periodic maintenance or changing. It is an additional objective of the present invention that it operate to effectively separate the gas in the gas stream from particulates contained therein while using as little gas as possible.

It is a still further objective of the present invention that it be relatively compact and inexpensive, both to construct, as well as to operate and maintain. The particulate separator of the present invention should also enable the conversion of the high pressure gas stream containing particulates to a low pressure outlet flow of gas at a first output point, and a low pressure outflow of particulates and a small amount of gas at a second output point. Finally, it is also an objective that all of the aforesaid advantages and objectives be achieved without incurring any substantial relative disadvantage.

SUMMARY OF THE INVENTION

The disadvantages and limitations of the background art discussed above are overcome by the present invention. With this invention, a particulate separator is disclosed which will separate even very small particles from a high pressure, continuous flow gas stream with a high degree of efficiency. As such, the particulate separator of the present invention is suitable for use with a reactor vessel to separate the particulates contained in the gas stream exhausted from the reactor.

The particulate separator of the present invention uses electrostatic principles at two different points in the separation operation. Prior to arriving at either of these two points, the particulates in the gas stream are electrostatically charged as they pass through a plasma zone in the flow path from the reactor vessel. In the preferred embodiment, the particulates are all charged with a positive charge.

The flow path following the charging apparatus includes a particulate removal tube which has a cross-sectional area which smoothly varies from a larger cross-sectional area on the inlet end, to a smaller cross-sectional area in the central portion thereof, and back to a larger cross-sectional area on the outlet end. At the location of the smallest cross-sectional area in the central portion of the particulate removal tube, there is an aperture opening downwardly into a vortex generator. On the top side of the smallest cross-sectional area in the central portion of the particulate removal tube opposite the aperture leading to the vortex generator is a repelling plate which is charged with the same polarity as the charge on the particulates (a positive charge in the preferred embodiment).

The charge on the repelling plate forces the charged particulates away from the repelling plate as they pass through the smallest cross-sectional area in the central portion of the particulate removal tube. The charged particulates are thus forced through the aperture in the bottom of the smallest cross-sectional area in the central portion of the particulate removal tube into the vortex generator. The gas stream continues to flow through the particulate removal tube toward the outlet end thereof, with the particulates removed. The cleaned gas stream then leaves the particulate removal tube, and flows through a pressure letdown device, at the outlet of which the cleaned gas stream exits at atmospheric pressure.

The vortex generator comprises a cylindrical chamber which is closed on both ends, with the aperture through which the particulates enter the vortex generator being on the side of the cylindrical chamber approximately midway between the two ends and at the top thereof. This top position will be referred to as the twelve o'clock position. A control gas is supplied tangentially to the vortex generator from the side of the cylindrical chamber at nine o'clock, and flows clockwise in the cylindrical chamber.

Two rotating disks are located in the vortex generator parallel to and adjacent the ends of the cylindrical chamber. The area between the two rotating disks, which rotate clockwise, includes the area into which the particulates and the control gas flow. As the center of one of the disks is an aperture through which particulates and control gas may leave the vortex generator. Thus, it will be appreciated by those skilled in the art that a vortex will be created by the tangential infusion of the control gas which exits at the center of one of the disks. The vortex will act to remove the particulates forced into the vortex generator.

The present invention at this point uses the charge on the particulates for a second time. The rotating disks have a plurality of spaced-apart, pie-shaped conductive segments on their facing sides. When the conductive segments are oriented from approximately 12 o'clock to four o'clock, the conductive segments on the disks are charged (negatively, in the preferred embodiment) to attract the charged particulates. Thus, the charged particulates will rotate with the conductive segments on the disks from the 12 o'clock position to the 4 o'clock position.

When the conductive segments on the disks reach the 4 o'clock position, the conductive segments on the disks are charged (positively, in the preferred embodiment) to repel the charged particulates. The charged particulates will move off of the conductive segments on the disk, and, caught up in the vortex created by the control gas, will exit the vortex generator through the aperture in the disk. The control gas stream and the particulates then flow through a pressure letdown device, at the outlet of which the control & gas and particulates exit at atmospheric pressure.

It may therefore be seen that the present invention teaches a device which operates to remove substantially all of the particulates contained in the gas stream emanating from a reactor vessel. The particulate separator of the present invention is operable on a continuous, high pressure gas stream which includes particulates to process the gas stream to remove the particulates as efficiently as is possible. The particulate separator will operate to remove the small particulates typically contained in a reactor vessel gas stream, despite the fact that & they range from approximately two to five microns, and thereby have small settling rates.

The particulate removal system of the present invention operates in a manner not requiring a scrubbing fluid, therefore not further exacerbating the problem of substance disposal. In addition, the present invention does not involve the use of a filter medium and its attendant problems of clogging or requiring periodic maintenance or changing. The present invention also effectively separates the gas in the gas stream from particulates contained therein while using as little gas in the particulate waste stream as is possible.

In addition, the particulate separator of the present invention is relatively compact and inexpensive, both to construct, and also to operate and maintain. The particulate separator of the present invention enables the conversion of the high pressure gas stream containing particulates into a low pressure outlet flow of gas at a first output point, and a low pressure outflow of particulates and a small amount of gas at a second output point. Finally, all of the aforesaid advantages and objectives are achieved without incurring any substantial relative disadvantage.

BRIEF DESCRIPTION OF THE DRAWINGS

These and other advantages of the present invention are best understood with reference to the drawings, in which:

FIG. 1 is an isometric view of a curved electrode plate;

FIG. 2 is a top plan view of the curved electrode plate shown in FIG. 1;

FIG. 3 is an end view of the curved electrode plate shown in FIGS. 1 and 2;

FIG. 4 is a side view of an L-shaped electrode;

FIG. 5 is a downstream view of the L-shaped electrode shown in FIG. 4;

FIG. 6 is a side view of an insulated, threaded insert for use in mounting the L-shaped electrode shown in FIGS. 4 and 5;

FIG. 7 is a top view of the insert shown in FIG. 6;

FIG. 8 is a partially cut away side view of a segment of tubing in which two of the curved electrode plates shown in FIGS. 1 through 3 .are mounted on opposite sides, and in which the L-shaped electrode shown in FIGS. 4 and 5 is mounted using the insert shown in FIGS. 6 and 7 with the long leg of the L-shaped electrode disposed between the curved electrode plates;

FIG. 9 is an end view of the segment of tubing shown in FIG. 8 from the downstream end, showing the flange mounted thereon;

FIG. 10 is a plan view of the interior side of a first housing half defining half of the particulate removal tube and half of the cylindrical chamber defining the vortex generator, showing the narrowed central portion of the particulate removal tube, the bearing receiving aperture and the shaft aperture in the cylindrical chamber, the split ring commutator for charging conductive segments on the disk of a rotor, and half of the control gas inlet passageway;

FIG. 11 is an end view of the first housing half shown in FIG. 10 showing the outlet end of the particulate removal tube and the wires leading to the split ring commutator;

FIG. 12 is a first cross-sectional view of the first housing half shown in FIGS. 10 and 11 showing the aperture between the smallest cross-sectional area in the central portion of the particulate removal tube and the cylindrical chamber forming the vortex generator;

FIG. 13 is a second cross-sectional view of the first housing half shown in FIGS. 10 through 12 also showing the aperture between the smallest cross-sectional area in the central portion of the particulate removal tube and the cylindrical chamber forming the vortex generator;

FIG. 14 is a third cross-sectional view of the first housing half shown in FIGS. 10 through 13 showing the bearing receiving aperture and the shaft aperture in the cylindrical chamber, and half of the control gas inlet passageway;

FIG. 17 is an isometric view of a curved electrode plate for mounting in the smallest cross-sectional area in the central portion of the particulate removal tube (FIG. 10 and 15) opposite the aperture between the smallest cross-sectional area in the central portion of the particulate removal tube and the cylindrical chamber forming the vortex generator;

FIG. 18 is an end view of the curved electrode plate shown in FIG. 17;

FIG. 19 is a plan view of a bearing and seal for mounting in the bearing aperture in the first housing half shown in FIG. 10;

FIG. 20 is a side view of the bearing and seal shown in FIG. 19;

FIG. 21 is a plan view of a bearing and seal for mounting in the bearing aperture in the second housing half shown in FIG. 15;

FIG. 22 is a side view of the bearing and seal shown in FIG. 21;

FIG. 23 is a plan view of the disk of a first rotor for mounting in the first housing half shown in FIG. 10 using the bearing and seal shown in FIGS. 19 and 20;

FIG. 24 is a cross-sectional view of the first rotor shown in FIG. 23;

FIG. 25 is a plan view of the disk of a second rotor for mounting in the second housing half shown in FIG. 15 using the bearing and seal shown in FIGS. 21 and 22;

FIG. 26 is a cross-sectional view of the second rotor shown in FIG. 25;

FIG. 27 is a cross-sectional view of an L-shaped connector tube having at one end thereof a seal therein for rotatably receiving the shaft of the first rotor shown in FIGS. 23 and 24, and having a flange disposed at the other end thereof;

FIG. 28 is a cutaway view of a pressure letdown device having disposed therein a plurality of plates with apertures in them;

FIG. 29 is an end view of the pressure letdown device shown in FIG. 28 from the inlet end, showing a flange mounted thereon;

FIG. 30 is an end view of the pressure letdown device shown in FIGS. 28 and 29 from the outlet end, showing the apertures in the plates located therein;

FIG. 31 is a partially cutaway side view of a control gas supply tube;

FIG. 32 is a top plan view of the control gas supply tube of FIG. 31 showing a flange located thereon;

DETAILED DESCRIPTION OF THE PREFERRED EMBODIMENT

Figure 16:
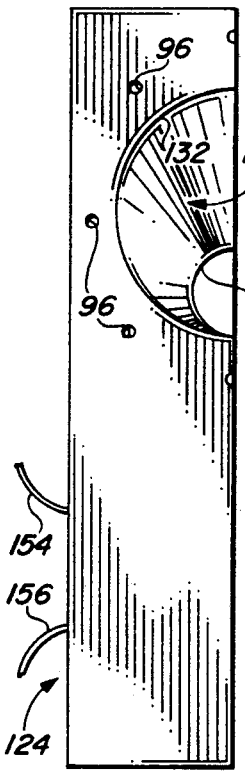
FIG. 16 is an end view of the second housing half shown in FIG. 15 showing the outlet end of the particulate removal tube and the wires leading to the split ring commutator.

The preferred embodiment charges particulates to utilize electrostatic principles in the separation of the particulates from a gas stream. The various components used to accomplish the charging of particulates carried in the gas stream from a reactor vessel, or from another source of contaminated gas, are shown in FIGS. 1 through 9. Referring first to FIGS. 1 through 3, a curved electrode plate 40 is illustrated which will be used as one electrode to charge the particulates in the gas stream. The curved electrode plate 40 is curved to fit on the inner diameter of a segment of tubing (not shown) Which, in the preferred embodiment, will have an inner diameter of approximately one to two inches. The exact size of the tubing to be used will depend on the characteristics of the gas stream and the particulates in the gas stream.

The curved electrode plate 40 has a threaded stud 42 mounted in a central position on the convex side thereof, with the threaded stud 42 being orthogonal to a plane tangent to the convex side of the curved electrode plate 40. The threaded stud 42 may be soldered to the curved electrode plate 40. The curved electrode plate 40 and the threaded stud 42 are both made of conductive material.

Referring now to FIGS. 4 and 5, an L-shaped electrode 44 is illustrated which will be used as the other electrode to charge the particulates in the gas stream. The L-shaped electrode 44 has a long leg 46 terminating in a pointed tip 48. The shorter leg 50 of the L-shaped electrode 44 is threaded to facilitate mounting of the L-shaped electrode 44.

Referring next to FIGS. 6 and 7, an insulated, threaded insert 52 for use in mounting the L-shaped electrode 44 (FIGS. 4 and 5) is illustrated. The insulated, threaded insert 52 has a thinner diameter cylindrical top portion, and a thicker diameter cylindrical bottom portion. An aperture 54 extends through the top and bottom portions of the insulated, threaded insert 52. The length of the cylindrical top portion is approximately the same, or slightly less than, the wall thickness of a tube (not shown) in which the L-shaped electrode 44 will be mounted.

Referring now to FIGS. 8 and 9, the components of FIGS. 1 through 7 are shown mounted into a segment of tubing 56, one end of which has a radially outwardly extending flange 58 mounted thereon. The end of the tubing 56 having the flange 58 mounted thereon will be the outlet end of the tubing 56, with the other end of the tubing 56 being the inlet end of the tubing 56.

The top side of the tubing 56 has an aperture 60 located therein, with another aperture 62 being located diametrically opposite the aperture 60 in the bottom of the tubing 56. A third aperture 64 is also located in the top side of the tubing 56, and is spaced toward the inlet end of the tubing 56 from the aperture 60.

One of the curved electrode plates 40 is located inside the tubing 56 on the top side thereof, with the threaded stud 42 of the curved electrode plate 40 extending through the aperture 60. A nut 66 is attached to the threaded stud 42 of the curved electrode plate 40 located on the top inside wall of the tubing 56. The nut 66 secures (electrically and mechanically) both a wire 68 and the curved electrode plate 40 located on the top inside wall of the tubing 56.

Another one of the curved electrode plates 40 is located inside the tubing 56 on the bottom side thereof, with the threaded stud 42 of the curved electrode plate 40 extending through the aperture 62. A nut 70 is attached to the threaded stud 42 of the curved electrode plate 40 located on the bottom inside wall of the tubing 56. The nut 70 secures (electrically and mechanically) both a wire 72 and the curved electrode plate 40 located on the bottom inside wall of the tubing 56.

The insulated, threaded insert 52 is screwed onto the threaded shorter leg 50 of the L-shaped electrode 44 with the threaded shorter leg 50 being inserted into the thicker diameter cylindrical bottom portion of the insulated, threaded insert 52. The L-shaped electrode 44 is inserted into the interior of the tubing 56, and the threaded shorter leg 50 of the L-shaped electrode 44 is inserted through the aperture 64 in the tubing 56.

A washer 74 is installed onto the threaded shorter leg 50 of the L-shaped electrode 44. A nut 76 is installed onto the threaded shorter leg 50 of the L-shaped electrode 44. The nut 76 is used to secure (electrically and mechanically) both a wire 78 and the L-shaped electrode 44 located inside the tubing 56. Note that the curved electrode plates 40 are located opposite each other, and that the long leg 46 and the pointed tip 48 of the L-shaped electrode 44 are located between the curved electrode plates 40. The pointed tip 48 of the L-shaped electrode 44 is directed toward the outlet end of the tubing 56.

The flange 58 of the tubing 56 has disposed therein on the side facing away from the tubing 56 an annular recess 80 surrounding and spaced radially outwardly away from the aperture in the tubing 56. The flange 58 has a plurality of longitudinally extending apertures 82 disposed uniformly around the outer perimeter of the flange 58 near the outer diameter thereof.

Referring now to FIGS. 10 through 14, a first housing half 84 is illustrated which defines half of the housing of the particulate separator of the present invention. In the preferred embodiment contained herein, the housing of the particulate separator is made of plastic material in two halves which are fastened together adhesively. In fact, it could be made in any of a number of different ways which will occur to one skilled in the art upon reading this disclosure.

The first housing half 84 is made of a rectangular block of material machined or molded to form the features specified below. First, a particulate removal tube half (indicated generally at 86) is located in and extends between the sides of the top half of the first housing half 84. The particulate removal tube half 86 is semicircular in cross-section throughout, and varies uniformly from a larger diameter portion 88 on the left side of the first housing half 84 (as seen in FIG. 10) to a smaller diameter portion 90 in the central portion of the first housing half 84, and back to a larger diameter portion 92 on the right side of the first housing half 84 (as seen in FIG. 10).

The larger diameter portion 88 of the particulate removal tube half 86 is the inlet portion of the particulate removal tube half 86. The larger diameter portion 92 of the particulate removal tube half 86 is the outlet portion of the particulate removal tube half 86. A plurality of threaded apertures 94 are disposed on the left end of the first housing half 84 in a semi-circular array around the larger diameter portion 88 of the particulate removal tube half 86. Similarly, a plurality of threaded apertures 96 are disposed on the right end of the first housing half 84 in a semi-circular array around the larger diameter portion 92 of the particulate removal tube half 86.

A passageway half 98 having a semi-circular cross-section extends vertically from the top of the smaller diameter portion 90 of the particulate removal tube half 86 to the top of the first housing half 84.

Located in the bottom half of the first housing half 84 is a cylindrical recess 100 which will house half of the vortex generator. The cylindrical recess 100 in the preferred embodiment is just greater than three inches in diameter, and extends approximately one-third of the way through the first housing half 84. Located in the center of and coaxial with the cylindrical recess 100 is a bearing receiving aperture 102.

The bearing receiving aperture 102 has a diameter substantially less than that of the cylindrical recess 100. The bearing receiving aperture 102 extends approximately two-thirds of the way through the first housing half 84. Located in the center of and coaxial with the bearing receiving aperture 102 is a shaft aperture 104, which extends through the first housing half 84. The shaft aperture 104 has a diameter less than that of the bearing receiving aperture 102.

An aperture 106 extends between the smaller diameter portion 90 of the particulate removal tube half 86 and the cylindrical recess 100. This aperture 106 is half of the passage through which particulates will pass in exiting from the gas stream into the vortex generator.

A control gas inlet portion half 107 having a semi-circular cross-section extends vertically upwards from the bottom of the first housing half 84. A control gas inlet passageway half 108 having a thin rectangular (slot-shaped) cross-section extends vertically from the left side of the cylindrical recess 100 (as seen in FIG. 10) to the top of the control gas inlet portion half 107, with which it is in fluid communication. The slot-shaped configuration of the control gas inlet passageway half 108 extends the entire depth of the cylindrical recess 100 (as best shown in FIGS. 12 and 14), and in the preferred embodiment is approximately 0.010 inches wide.

A reference system to be used herein may now be defined with respect to the view of the cylindrical recess 100 shown in FIG. 10. The top of the cylindrical recess 100 which communicates with the aperture 106 shall be referred to as 12 o'clock, and thus the control gas inlet passageway half 108 communicates with the cylindrical recess 100 at 9 o'clock.

The control gas inlet passageway half 108 is thus located tangentially with respect to the cylindrical recess 100, and control gas emanating from the control gas inlet passageway half 108 will flow clockwise in the cylindrical recess 100 as viewed in FIG. ID A plurality of threaded apertures 109 are disposed on the bottom of the first housing half 84 in a semi-circular array around the control gas inlet passageway half 108.

Mounted in the end of the cylindrical recess 100 surrounding and spaced radially outwardly from the bearing receiving aperture 102 are two split ring commutator segments 110 and 112. The split ring commutator segment 110 extends from 11 o'clock or so to about three o'clock. The split ring commutator segment 112 extends from 4 o'clock or so to about 10 o'clock. The split ring commutator segment 110 is electrically connected to a wire 114, which extends out of the first housing half 84 on the outside thereof. Similarly, the split ring commutator segment 112 is electrically connected to a wire 116, which extends out of the first housing half 84 on the outside thereof.

Figure 15:
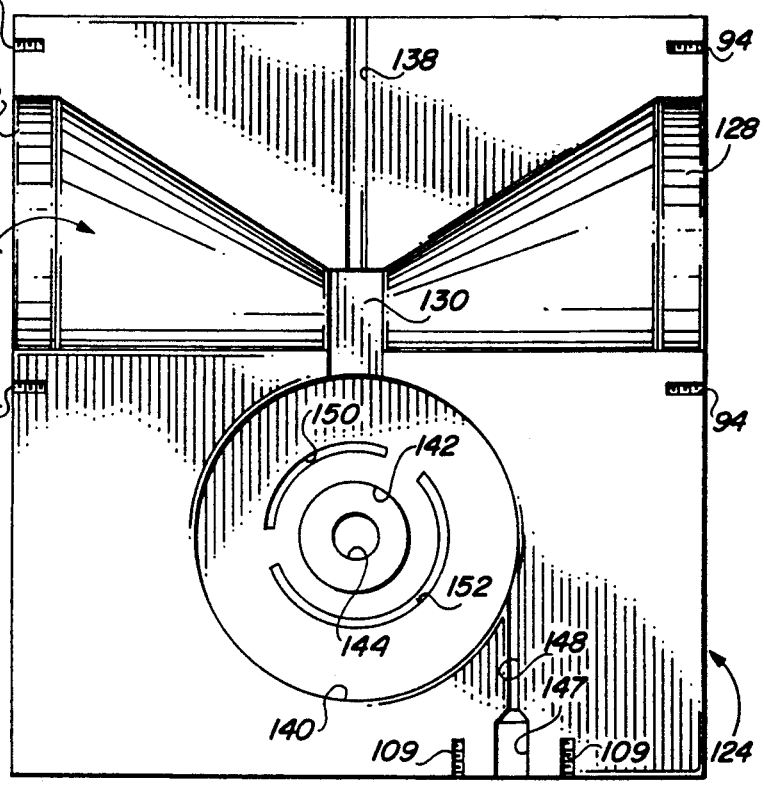
FIG. 15 is a plan view of the interior side of a second housing half defining half of the particulate removal tube and half of the cylindrical chamber defining the vortex generator, showing the narrowed central portion of the particulate removal tube, the bearing receiving aperture and the shaft aperture in the cylindrical chamber, the split ring commutator for charging conductive segments on the disk of a rotor, and half of the control gas inlet passageway.

Referring now to FIGS. 15 and 16, a second housing half 124 is illustrated Which defines the other half of the housing of the particulate separator of the present invention. During the discussion of the second housing half 124, reference may periodically be made to the first housing half 84 (FIGS. 10 through 14), which is shown in greater detail. Differences in construction will be specifically noted; otherwise, the second housing half 124 is a mirror image of the first housing half 84.

The second housing half 124 is also made of a rectangular block of material machined or molded to form the features specified below. First, a particulate removal tube half (indicated generally at 126) is located in and extends between the sides of the top half of the second housing half 124. The particulate removal tube half 126 is semicircular in cross-section throughout, and Varies uniformly from a larger diameter portion 128 on the right side of the second housing half 124 (as seen in FIG. 15) to a smaller diameter portion 130 in the central portion of the second housing half 124, and back to a larger diameter portion 132 on the left side of the second housing half 124 (as seen in FIG. 15).

The particulate removal tube half 126 in the second housing half 124 and the particulate removal tube half 86 in the first housing half 84 together form a single particulate removal tube having a circular cross-section throughout.

The larger diameter portion 128 of the particulate removal tube half 126 is the inlet portion of the particulate removal tube half 126. The larger diameter portion 132 of the particulate removal tube half 126 is the outlet portion of the particulate removal tube half 126. A plurality of threaded apertures 94 are disposed on the right end of the second housing half 124 in a semi-circular array around the larger diameter portion 128 of the particulate removal tube half 126. Similarly, a plurality of threaded apertures 96 are disposed on the left end of the second housing half 124 in a semi-circular array around the larger diameter portion 132 of the particulate removal tube half 126.

A passageway half 138 having a semi-circular cross-section extends vertically from the top of the smaller diameter portion 130 of the particulate removal tube half 126 to the top of the second housing half 124. The passageway half 138 in the second housing half 124 and the passageway half 98 in the first housing half 84 together form a single passageway having a circular cross-section.

Located in the bottom half of the first housing half 124 is a cylindrical recess 140 which will house the other half of the vortex generator. The cylindrical recess 140 in the preferred embodiment is just greater than three inches in diameter, and extends approximately one-third of the way through the second housing half 124. The cylindrical recess 140 in the second housing half 124 and the cylindrical recess 100 in the first housing half 84 together form a single cylindrical recess.

Located in the center of and coaxial with the cylindrical recess 140 is a bearing receiving aperture 142. The bearing receiving aperture 142 has a diameter substantially less than that of the cylindrical recess 140. In addition, the bearing receiving aperture 142 has a diameter less than the diameter of the bearing receiving aperture 102 in the first housing half 84. The bearing receiving aperture 142 extends approximately two-thirds of the way through the second housing half 124.

Located in the center of and coaxial with the bearing receiving aperture 142 is a shaft aperture 144, Which extends through the second housing half 124. The shaft aperture 144 has a diameter less than that of the bearing receiving aperture 142. In addition, the shaft aperture 144 has a diameter less than the diameter of the shaft aperture 104 in the first housing half 84.

An aperture 146 extends between the smaller diameter portion 130 of the particulate removal tube half 126 and the cylindrical recess 140. This aperture 146 is half of the passage through which particulates will pass in exiting from the gas stream into the vortex generator. The entire passage consists of the aperture 146 in the second housing half 124 together with the aperture 106 in the first housing half 84.

A control gas inlet portion half 147 having a semi-circular cross-section extends vertically upwards from the bottom of second housing half 124. A control gas inlet passageway half 148 having a thin rectangular (slot-shaped) cross-section extends vertically from the right side of the cylindrical recess 140 (as seen in FIG. to the top of the control gas inlet portion half 147, with which it is in fluid communication. The slot-shaped configuration of the control gas inlet passageway half 148 extends the entire depth of the cylindrical recess 140, and in the preferred embodiment is approximately 0.010 inches wide.

The control gas inlet portion half 147 in the second housing half 124 and the control gas inlet portion half 107 in the first housing half 84 together form the control gas inlet portion. The control gas inlet passageway half 148 in the second housing half 124 and the control gas inlet passageway half 108 in the first housing half 84 together form the control gas inlet passageway, which is in fluid communication with the control gas inlet portion.

The control gas inlet passageway half 148 is thus located tangentially with respect to the cylindrical recess 140, and control gas emanating from the control gas inlet passageway half 148 will flow counterclockwise in the cylindrical recess 140 as viewed in FIG. 15. A plurality of threaded apertures 109 are disposed on the bottom of the second housing half 124 in a semi-circular array around the control gas inlet passageway half 148.

Mounted in the end of the cylindrical recess 140 surrounding and spaced radially outwardly from the bearing receiving aperture 142 are two split ring commutator segments 150 and 152. The split ring commutator segments 150 and 152 have a radius the same as the radius of the split ring commutator segments 110 and 112 in the first housing half 84. The split ring commutator segments 150 and 152 are mirror images of the split ring commutator segments 110 and 112 in the first housing half 84. The split ring commutator segment 150 is electrically connected to a wire 154, which extends out of the second housing half 124 on the outside thereof. Similarly, the split ring commutator segment 152 is electrically connected to a wire 156, which extends out of the second housing half 124 on the outside thereof.

Referring now to FIGS. 17 and 18, a curved electrode plate 158 is illustrated Which is contoured to fit into the top of the smaller diameter portions 90 and 130 of the particulate removal tubes 86 and 126, respectively. When installed in this location, the curved electrode plate 158 is located opposite the apertures 106 and 146. The curved electrode plate 158 has a long stud 160 mounted in a central position on the convex side thereof, with the long stud 160 being orthogonal to a plane tangent to the convex side of the curved electrode plate 158. The threaded stud 160 may be soldered to the curved electrode plate 158. The curved electrode plate 158 and the threaded stud 160 are both made of conductive material. The end of the long stud 160 not attached to the curved electrode plate 158 is threaded.

Referring now to FIGS. 19 and 20, a bearing and seal 162 for mounting in the bearing receiving aperture 102 in the first housing half 84 (FIG. 10) is illustrated. The outer diameter of the bearing and seal 162 is sized for an interference fit in the bearing receiving aperture 102.

Referring now to FIGS. 21 and 22, a bearing and seal 164 for mounting in the bearing receiving aperture 142 in the second housing half 124 (FIG. 15) is illustrated. The outer diameter of the bearing and seal 164 is sized for an interference fit in the bearing receiving aperture 142.

Referring next to FIGS. 23 and 24, a first rotor 166 consisting of a disk 168 mounted on a hollow shaft 170 is illustrated. The disk 168 is approximately three inches in diameter in the preferred embodiment, and is made of a dielectric material such as plastic. The hollow shaft 170 is attached to the disk 168 at the center thereof, and the aperture through the hollow shaft 170 extends through to the front of the disk 168.

The diameter of the hollow shaft 170 is sized to fit in the inner diameter of the bearing and seal 162 (FIGS. 19 and 20) to support the disk 168 and the hollow shaft 170 for rotation. Thus, the diameter of the disk 168 is just less than the diameter of the cylindrical recess 100 (FIG. 10).

Mounted in recessed, spaced-apart fashion On the front side of the disk 168 are a plurality of pie-shaped conductive segments 172. In the preferred embodiment shown there are eight conductive segments 172. There could be from approximately four to twenty conductive segments 172 on the disk 168. The conductive segments 172 are preferably made of copper.

Located on the back side of the disk 168 are eight contacts 174 which are each electrically connected to one of the eight conductive segments 172. The radius at which the contacts 174 are mounted is equal to the radius at which the split ring commutator segments 110 and 112 (FIG. 10) are mounted in the first housing half 84. Thus, as the first rotor 166 rotates, the contacts 174 will move in contact With the split ring commutator segments 110 and 112, continuously connecting the conductive segments 172 to one of the wires 114 and 116 (FIG. 10).

Located on the hollow shaft 170 is a keyway 175, which will be used to mount a gear (not shown) for driving the first rotor 166.

Referring next to FIGS. 25 and 26, a second rotor 176 consisting of a disk 178 mounted on a solid shaft 180 is illustrated. The disk 178 is also approximately three inches in diameter in the preferred embodiment, and is made of a dielectric material such as plastic. The shaft 180 is attached to the disk 178 at the center thereof.

The diameter of the shaft 180 is sized to fit in the inner diameter of the bearing and seal 164 (FIGS. 21 and 22) to support the disk 178 1 and the shaft 180 for rotation. Thus, the diameter of the disk 178 is just less than the diameter of the cylindrical recess 140 (FIG. 15).

Mounted in recessed, spaced-apart fashion on the front side of the disk 178 are a plurality of pie-shaped conductive segments 182. In the preferred embodiment shown there are eight conductive segments 182. The conductive segments 182 are preferably made of copper.

Located on the back side of the disk 178 are eight contacts 184 which are each electrically connected to one of the eight conductive segments 182. The radius at which the contacts 184 are mounted is equal to the radius at which the split ring commutator segments 150 and 152 (FIG. 15) are mounted in the second housing half 124. Thus, as the second rotor 176 rotates, the contacts 184 will move in contact with the split ring commutator segments 150 and 152, continuously connecting the conductive segments 182 to one of the wires 154 and 156 (FIG. 15).

Located on the shaft 180 is a keyway 185, which will be used to mount a gear (not shown) for driving the second rotor 176.

Referring next to FIG. 27, an L-shaped connector tube 190 is illustrated. The L-shaped connector tube 190 has at One end thereof a seal 192 therein for sealingly, rotatably receiving the end of the hollow shaft 170 of the first rotor 166 (FIGS. 23 and 24). The other end of the L-shaped connector tube 191 has a flange 194 mounted thereon. The flange 194 has a plurality of longitudinally extending threaded apertures 196 disposed uniformly around the outer perimeter of the flange 194 near the outer diameter thereof.

Referring now to FIGS. 28 through 30, a pressure letdown device 200 having a body 202 open at the ends thereof is illustrated. A flange 204 is mounted on the body 202 at the inlet end of the pressure letdown device 200. The flange 204 has disposed therein on the side facing away from the body 202 of the pressure letdown device 200 an annular recess 206 surrounding and spaced radially outwardly away from the aperture in the flange 204. The flange 204 has a plurality of longitudinally extending apertures 208 disposed uniformly around the outer perimeter of the flange 204 near the outer diameter thereof.

Disposed inside the body 202 of the pressure letdown device 200 are a plurality of plates 210, 212, 214, 216, 218, and 220 each having an aperture 222, 224, 226, 228, 230, and 232, respectively, therein. The plates 210, 212, 214, 216, 218, and 220 and apertures 222, 226, 228, 230, and 232 function to drop the pressure from high pressure at the inlet of the pressure letdown device 200 on the left to atmospheric pressure at the outlet on the right.

The apertures 222, 224, 226, 228, 230, and 232 are in effect orifices which produce pressure drops. The apertures 222, 224, 226, 228, 230, and 232 continually increase in size to maintain velocity through the apertures, thereby minimizing erosion. In addition, the apertures 222, 224, 226, 228, 230, and 232 are offset or staggered from each other as shown to allow the plates 210, 212, 214, 216, 218, and 220 to be closer to each other (smaller plenums). The outlet side of the body 202 has a segment of the tubing 234 mounted thereon.

Referring next to FIGS. 31 and 32, a control gas supply tube 236 is illustrated. The control gas supply tube 236 has a flange 238 mounted thereon at the outlet end of the control gas supply tube 236. The flange 238 has disposed therein on the side facing away from the control gas supply tube 236 an annular recess 240 surrounding and spaced radially outwardly away from the aperture in the flange 238. The flange 238 has a plurality of longitudinally extending apertures 242 disposed uniformly around the outer perimeter of the flange 238 near the outer diameter thereof.

Figure 35:
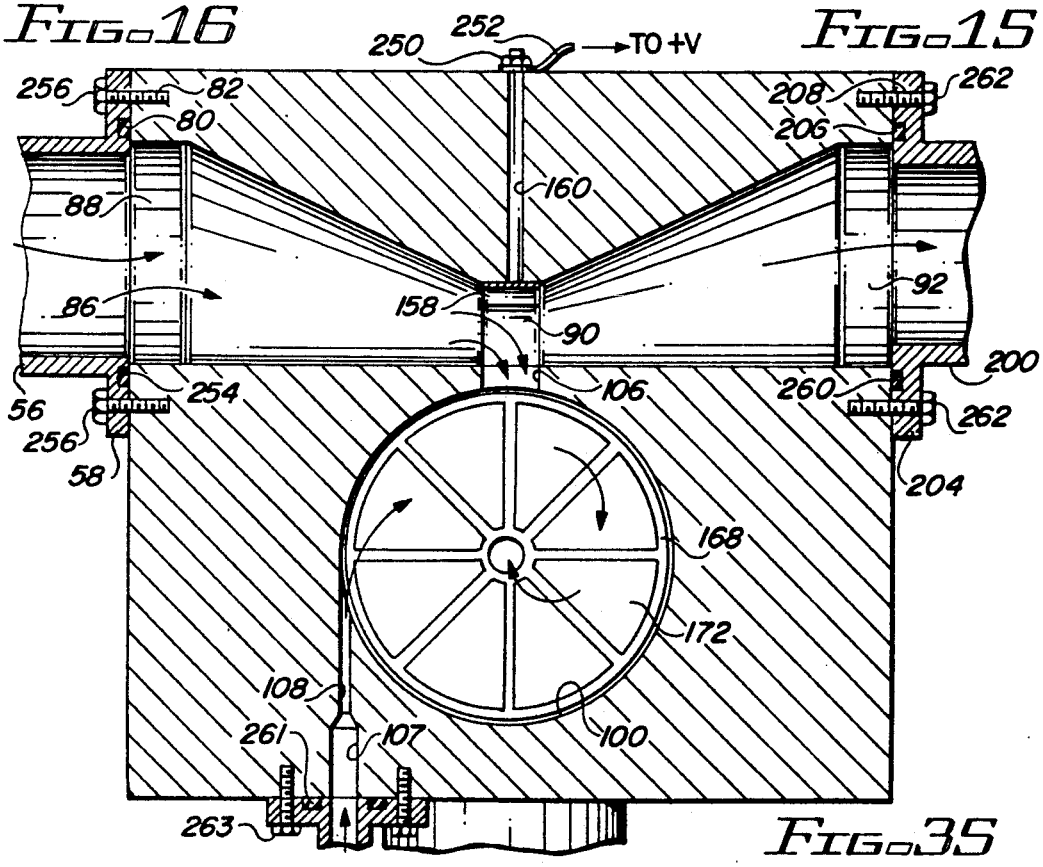
FIG. 35 is a sectional view of the assembled first housing of the particulate separator of the present invention showing the flow path of particulates, the flow path of the control gas, and the rotation of the disk of the first rotor.
Figure 33:
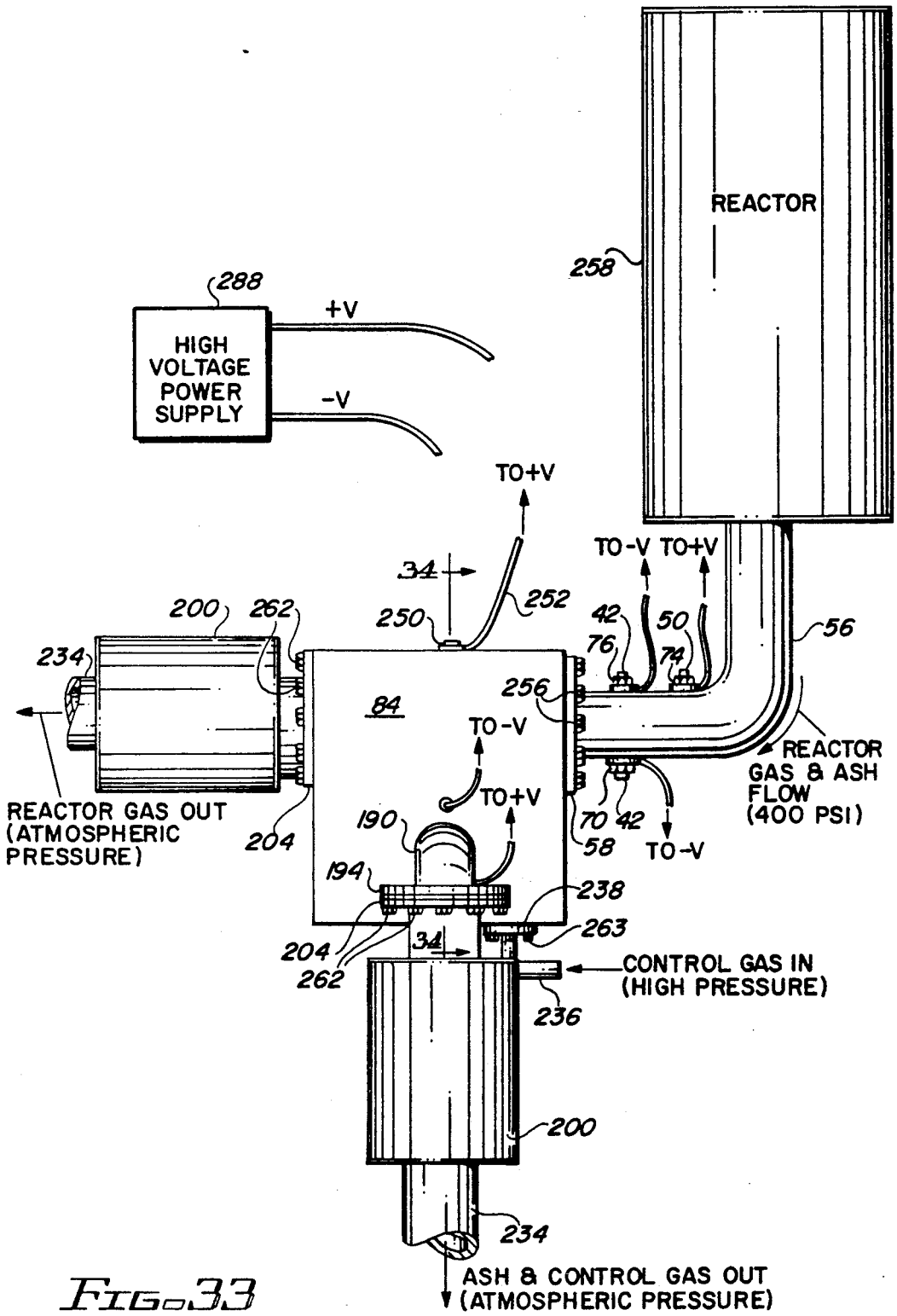
FIG. 33 is a side view of the particulate separator system of the present invention showing a reactor vessel, a high voltage power supply, and the relative location of the various components shown in the figures described above.
Figure 34:
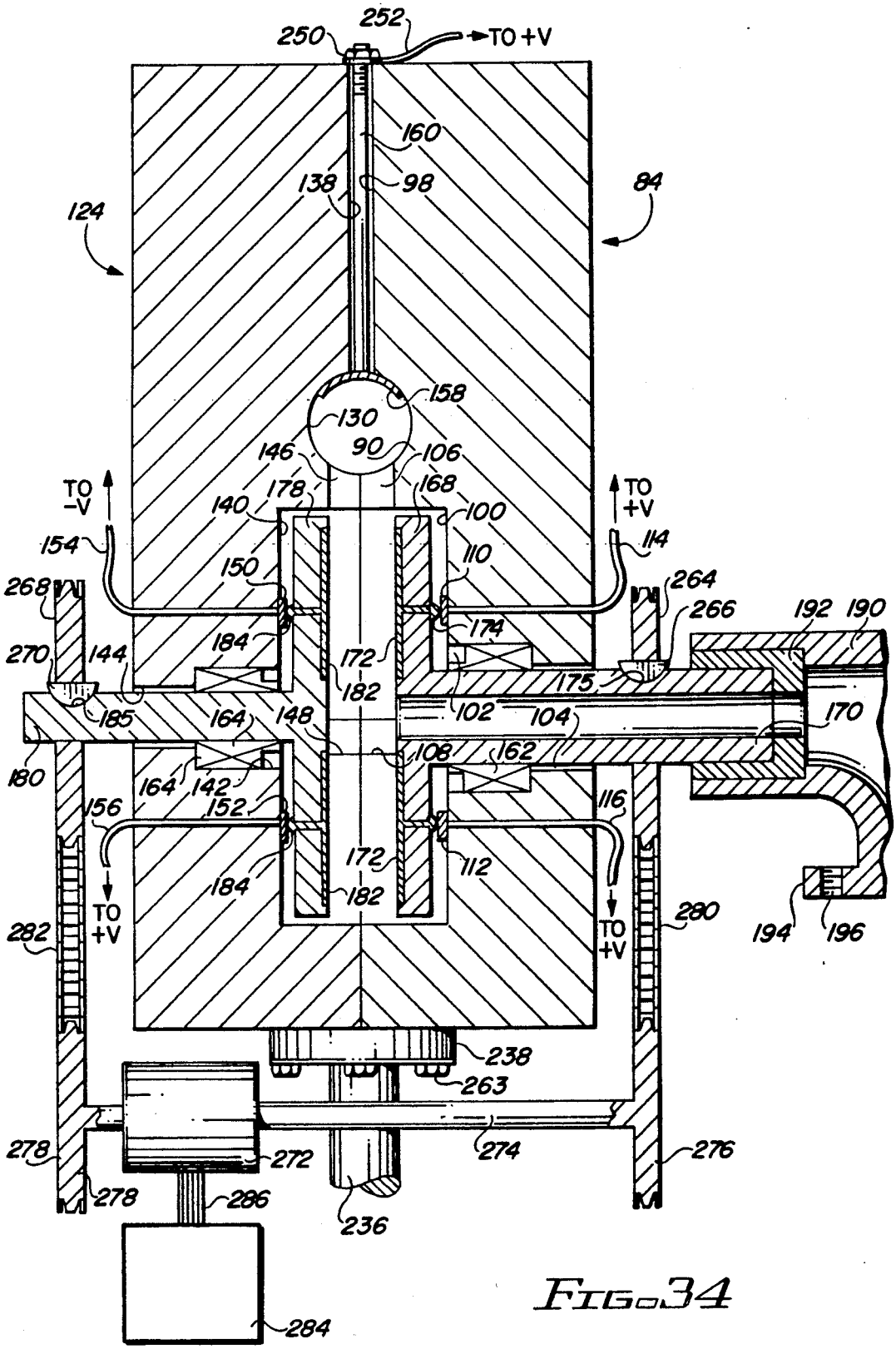
FIG. 34 is a sectional view of the assembled housing of the particulate separator of the present invention showing the gear drive used to turn the disks of the first and second rotors.

Referring finally to FIGS. 33 through 35, the assembly and operation of the particulate separator of the present invention may now be discussed. As shown in FIG. 34, the first rotor 166 (FIGS. 23 and 24) is mounted in the first housing half 84 (FIG. 10), and the second rotor 176 (FIGS. 25 and 26) is mounted in the second housing half 124 (FIG. 15).

The curved electrode plate 158 is mounted at the top of the smaller diameter portions 90 and 130 of the particulate removal tubes 86 and 126, respectively. When installed in this location, the curved electrode plate 158 is located opposite the apertures 106 and 146. The long stud 160 extends through the passageway created by the passageway halves 98 and 138.

At this point the first housing half 84 and the second housing half 124 are mounted together, preferably using adhesive mounting means. In other embodiments, multiple housing parts may be mounted together with gaskets used instead of an adhesive to provide a seal between the respective housing parts. Following assembly of the housing, the curved electrode plate 158 is secured in place by placing a nut 250 on the threaded end of the long stud 160. The nut 250 secures (electrically and mechanically) both a wire 252 and the curved electrode plate 158.

The apparatus used to charge the particulates (FIGS. 8 and 9) is installed onto the first housing half 84 and the second housing half 124. An O-ring 254 is installed in the annular recess 80 on the flange 58. A plurality of bolts 256 are placed through the apertures 82 in the flange 58 and are screwed into the threaded apertures 94 in the first housing half 84 (FIG. 10) and the second housing half 124 (FIG. 15). The end of the tubing 56 opposite the flange 58 is attached to a reactor 258 (FIG. 33).

One of the pressure letdown devices 200 is installed onto the first housing half 84 and the second housing half 124. An O-ring 260 is installed in the annular recess 206 on the flange 204. A plurality of bolts 262 are placed through the apertures 208 in the flange 204 and are screwed into the threaded apertures 96 in the first housing half 84 (FIG. 10) and the second housing half 124 (FIG. 15).

The L-shaped connector tube 190 (FIG. 27) is connected With the seal 192 installed on the end of the hollow shaft 170 of the first rotor 166 (FIGS. 23 and 24). A second one of the pressure letdown devices 200 is installed onto the L-shaped connector tube 190. An O-ring 260 (not shown) is installed in the annular recess 206 on the flange 204. A plurality of bolts 262 are placed through the apertures 208 in the flange 204 and are screwed into the threaded apertures 196 in the flange 194 of the L-shaped connector tube 190.

The control gas supply tube 236 is connected to communicate with the control gas inlet portion half 107 and the control gas inlet portion half 147, and thus with the control gas inlet passageway half 108 and the control gas inlet passageway half 148. An O-ring 261 is installed in the annular recess 240 on the flange 238. A plurality of bolts 263 are placed through the apertures 242 in the flange 238 and are screwed into the threaded apertures 109 in the bottom of the first housing half 84 and the second housing half 124.

Referring now specifically to FIG. 34, the drive mechanism for the first rotor 166 and the second rotor 176 may be described. A gear 264 is installed onto the hollow shaft 170 of the first rotor 166 using a key 266 located in the keyway 175 (FIG. 24). Similarly, a gear 268 is installed onto the hollow shaft 180 of the second rotor 176 using a key 270 located in the keyway 185 (FIG. 26).

A motor 272 located below the first housing half 84 and the second housing half 124 drives a shaft 274. The shaft 274 has a gear 276 located at one end thereof, and a gear 278 located at the other end thereof. The motor 272 thus drives the gears 276 and 278. The gear 276 drives the gear 264 using a chain 280, while the gear 278 drives the gear 268 using a chain 282. The motor 272 is operated by a DC power source 284 through wires 286.

The motor 272 thus drives the disks 168 and 178 on the first and second rotors 166 and 176, respectively, to rotate. Referring now to FIG. 35, the disk 168 on the first rotor 166 is driven in a clockwise direction. The disk 178 on the second rotor 176 would be driven in the same direction, and at the same speed as the disk 168 on the first rotor 166. In the preferred embodiment, the disks 168 and 178 are rotated at approximately 15 RPM. The speed of rotation, as well as the size of the disks 168 and 178, is dependent on the composition of the gas stream and the particulates contained therein.

A brief description of the operation of the device may now be given, again with reference to FIGS. 33 through 35. The motor 272 is used to rotate the disks 168 and 178 in the manner described above. Compressed air is supplied to the control gas supply tube 236, which directs the compressed air through the control gas inlet portion half 107 and the control gas inlet portion half 147 into the control gas inlet passageway half 108 and the control gas inlet passageway half 148, and thus into the cylindrical recess 100 and the cylindrical recess 140.

This generates a vortex, since the control gas will exit through the aperture in the hollow shaft 170 of the first rotor 166, and from there into the L-shaped connector tube 190 and the second pressure letdown device 200. The pressure of the control gas is of course dependent on the pressure of the gas stream exiting from the reactor 258. However, the control gas does act to form a vortex in the cylindrical recess 100 and the cylindrical recess 140.

A high voltage power supply 288 produces the high voltage necessary to perform the charging of the particulates and the electrostatic operation of the device. For example, a voltage of 1000 Volts from the high voltage power supply 288 may be utilized by the system of the present invention. The positive output of the high voltage power supply 288 is connected to the wire 78, the wire 252, the wire 114, and the wire 154. The negative output of the high voltage power supply 288 is connected to the wire 68, the wire 72, the wire 116, and the wire 156.

As particles pass through the tubing 56, they are charged with a positive charge. As they pass into the particulate removal tube halves 86 and 126, they are Channeled to the smaller diameter portions 90 and 130 of the particulate removal tube halves 86 and 126. At this point, the positive charge on the curved electrode plate 158 forces the positively charged particulates through the apertures 106 and 146 (which effectively form an airblock) into the vortex chamber.

The conductive segments 172 and 182 on the disks 168 and 178 adjacent the apertures 106 and 146 are negatively charged, and thus attract the positively charged particulates. As the conductive segments 172 and 182 on the disks 168 and 178 rotate to approximately four o'clock, they become positively charged and repel the positively charged particulates. At this point, the vortex airflow takes the particulates into the aperture in the hollow shaft 170 of the first rotor 166 and out of the device. Thus, the device operates to separate particulates from the gas stream from the reactor vessel.

It may therefore be appreciated from the above detailed description of the preferred embodiment of the present invention that it teaches a device which operates to remove substantially all of the particulates contained in the gas stream emanating from a reactor vessel. The particulate separator of the present invention is operable on a continuous, high pressure gas stream which includes particulates to process the gas stream to remove the particulates as efficiently as is possible. The particulate separator will operate to remove the small particulates typically contained in a reactor vessel gas stream, despite the fact that they range from approximately two to five microns, and thereby have small settling rates.

The particulate removal system of the present invention operates in a manner not requiring a scrubbing fluid, therefore not further exacerbating the problem of substance disposal. In addition, the present invention does not involve the use of a filter medium and its attendant problems of clogging or requiring periodic maintenance or changing. The present invention also effectively separates the gas in the gas stream from particulates contained therein while using as little gas in the particulate waste stream as is possible.

In addition, the particulate separator of the present invention is relatively compact and inexpensive, both to construct, and also to operate and maintain. The particulate separator of the present invention enables the conversion of the high pressure gas stream containing particulates into a low pressure outlet flow of gas at a first output point, and a low pressure outflow of particulates and a small amount of gas at a second output point. Finally, all of the aforesaid advantages and objectives are achieved without incurring any substantial relative disadvantage.

Although an exemplary embodiment of the present invention has been shown and described, it will be apparent to those having ordinary skill in the art that a number of changes, modifications, or alterations to the invention as described herein may be made, none of which depart from the spirit of the present invention. All such changes, modifications, and alterations should therefore be seen as within the scope of the present invention.

What is claimed is:

1. A method of separating particulates contained in a gas stream emanating from a source, comprising:

defining a flow path through which the gas stream flows, said flow path having an inlet portion and an outlet portion with a central portion disposed between said inlet and outlet portions;

charging particulates in the gas stream entering said inlet portion of said flow path;

generating a vortex flow with a vortex generator disposed outside said flow path adjacent said central portion of said flow path, said vortex flow leaving said vortex generator through a vortex outlet;

inducing particulates from the gas stream in said flow path to pass from said central portion of said flow path through a passageway located in said central portion of said flow path into said vortex generator; and diverting particulates entering said vortex generator into said vortex flow, and inwardly into said vortex outlet, whereby the particulates are exhausted from said vortex generator through said vortex outlet.

2. A device for separating particulates contained in a gas stream emanating from a source, comprising:

means for defining a flow path through which the gas stream flows, said flow path having an inlet portion and an outlet portion with a central portion disposed between said inlet and outlet portions;

means for charging particulates in the gas stream entering said inlet portion of said flow path;

a vortex generator disposed outside said flow path adjacent said central portion of said flow path, said vortex generator generating a vortex flow which leaves said vortex generator through a vortex outlet;

a passageway between said central portion of said flow path and said vortex generator;

means, disposed in said central portion of said flow path, for inducing particulates from the gas stream in said flow path to pass through said passageway into said vortex generator; and means, located in said vortex generator, for diverting particulates entering said vortex generator into said vortex flow, whereby the particulates are exhausted from said vortex generator through said vortex outlet.

3. A device as defined in claim 2, additionally comprising:

pressure letdown means for dropping the pressure of the gas stream exiting said outlet portion of said flow path to atmospheric pressure.

4. A device as defined in claim 2, additionally comprising:

pressure letdown means for dropping the pressure of the vortex flow carrying particulates exiting said vortex outlet to atmospheric pressure.

5. A device as defined in claim 2, wherein said means for defining a flow path comprises:

a particulate removal tube having said inlet portion of said flow path at a first end thereof and said outlet portion of said flow path at a second end thereof, said central portion of said flow path being located intermediate said first and second ends of said particulate removal tube.

6. A device as defined in claim 5, wherein said particulate removal tube is made of a dielectric material.

7. A device as defined in claim 5, wherein said particulate removal tube is substantially circular in cross-section throughout the length thereof.

8. A device as defined in claim 5, wherein said particulate removal tube varies uniformly from a larger diameter portion at said first end thereof to a smaller diameter portion intermediate said first and second ends in the central portion of said flow path, and back to a larger diameter portion at said second end thereof.

9. A device as defined in claim 5, wherein said means for charging particulates comprises:

a segment of hollow tubing interposed between the source of the gas stream and particulates and said inlet portion of said flow path;

first electrode means disposed on the inner surface of said segment of hollow tubing; and second electrode means located in the interior of said segment of hollow tubing at a central location therein, a high voltage being placed across said first and second electrode means.

10. A device as defined in claim 9, wherein said first electrode means comprises:

a first curved plate mounted on the inner surface of said segment of hollow tubing on one side thereof; and a second curved plate mounted on the inner surface of said segment of hollow tubing on a side thereof opposite said first curved plate; and wherein said second electrode means comprises:

an L-shaped electrode having a leg disposed substantially longitudinally in the interior of said segment of hollow tubing intermediate said first and second curved plates.

11. A device as defined in claim 2, wherein said means for inducing particulates to pass through said passageway comprises:

electrostatic means for diverting particulates which have been charged by said means for charging particulates through said passageway and into said vortex generator.

12. A device as defined in claim 11, wherein said means for inducing particulates to pass through said passageway comprises:

a charged plate located in said central portion of said flow path on one side of said flow path, said passageway being located on an opposite side of said flow path, said charged plate having a charge which repels particulates which have been charged by said means for charging particulates.

13. A device as defined in claim 2, wherein said vortex generator comprises:

a cylindrical chamber having a first end and a second end, said passageway communicating with said cylindrical chamber in the side thereof at a first location intermediate said first and second ends of said cylindrical chamber; and a control gas inlet through which control gas is supplied under pressure to said cylindrical chamber, said control gas inlet being located in the side of said cylindrical chamber at a second location intermediate said first and second ends of said cylindrical chamber, said control gas entering said cylindrical chamber through said control gas inlet in essentially tangential fashion to create said vortex flow in a first rotational direction within said cylindrical chamber.

14. A device as defined in claim 13, wherein said vortex outlet is located in said cylindrical chamber at a location centered within said cylindrical chamber.

15. A device as defined in claim 13, wherein said means for diverting particulates into said vortex flow comprises:

electrostatic means for diverting particulates which have been charged by said means for charging particulates and which are entering said vortex generator into said vortex flow.

16. A device as defined in claim 15, wherein said means for diverting particulates into said vortex flow comprises:

a first rotor comprising a first disk mounted on a hollow shaft at a first end of said hollow shaft, said first disk being mounted for rotation in said cylindrical chamber adjacent to and parallel to said first end of said cylindrical chamber, a second end of said hollow shaft extending out of said cylindrical chamber;

a first plurality of pie-shaped conductive segments disposed on the side of said first disk facing said second end of said cylindrical chamber; and first means for supplying a charge to said first plurality of pie-shaped conductive segments disposed on said side of said first disk facing said second end of said cylindrical chamber in a manner diverting the particulates into said vortex flow.

17. A device as defined in claim 16, wherein said hollow shaft is open at said first end thereof in the center of said first disk to provide said vortex outlet, said vortex flow thus leaving said vortex generator through said second end of said hollow shaft.

18. A device as defined in claim 16, wherein said means for diverting particulates into said vortex flow additionally comprises:

a second rotor comprising a second disk mounted on a solid shaft at a first end of said solid shaft, said second disk being mounted for rotation in said cylindrical chamber adjacent to and parallel to said second end of said cylindrical chamber, a second end of said solid shaft extending out of said cylindrical chamber;

a second plurality of pie-shaped conductive segments disposed on the side of said second disk facing said first end of said cylindrical chamber; and second means for supplying a charge to said second plurality of pie-shaped conductive segments disposed on said side of said second disk facing said first end of said cylindrical chamber in a manner diverting the particulates into said vortex flow. for supplying a charge to said second plurality of pie-shaped conductive segments are arranged and configured to charge said first and second plurality of pie-shaped segments to a charge repelling particulates which have been charged by said means for charging particulates to allow the particulates to be exhausted from said vortex generator through said vortex outlet.

19. A device as defined in claim 18, wherein there are between four and twenty of said first plurality of pie-shaped conductive segments disposed on the side of said first disk, and between four and twenty of said second plurality of pie-shaped conductive segments disposed on the side of said second disk.

20. A device as defined in claim 18, wherein there are approximately eight of said first plurality of pie-shaped conductive segments disposed on the side of said first disk, and approximately eight of said second plurality of pie-shaped conductive segments disposed on the side of said second disk.

21. A device as defined in claim 18, wherein said first plurality of pie-shaped conductive segments disposed on the side of said first disk are recessed into the surface of said first disk, and wherein said second plurality of pie-shaped conductive segments disposed on the side of said second disk are recessed into the side of said second disk.

22. A device as defined in claim 18, wherein said first and second disks are each approximately three inches in diameter.

23. A device as defined in claim 18, additionally comprising:

means for rotating said first and second disks in the same direction and at the same angular velocity.

24. A device as defined in claim 23, wherein said first and second disks are rotated in said first rotational direction within said cylindrical chamber.

25. A device as defined in claim 23, wherein said first and second disks are rotated at a speed of approximately 15 RPM.

26. A device as defined in claim 23, wherein said first means for supplying a charge to said first plurality of pie-shaped conductive segments and said second means for supplying a charge to said second plurality of pie-shaped conductive segments are arranged and configured to charge said first and second plurality of pie-shaped segments to a charge attracting particulates which have been charged by said means for charging particulates when said first and second plurality of pie-shaped segments are located adjacent said passageway to move the particulates into said vortex flow, at which point said first means for supplying a charge to said first plurality of pie-shaped conductive segments and said second means for supplying a charge to said second plurality of pie-shaped conductive segments are arranged and configured to charge said first and second plurality of pie-shaped segments to a charge repelling particulates which have been charged by said means for charging particulates to allow the particulates to be exhausted from said vortex generator through said vortex outlet.

27. A device for separating particulates contained in a gas stream emanating from a source, comprising:

means for defining a flow path through which the gas stream flows, said flow path having an inlet portion and an outlet portion with a central portion disposed between said inlet and outlet portions;

first electrostatic means for charging particulates in the gas stream entering said inlet portion of said flow path;

a vortex generator means for directing a gas stream and particulates inwardly which is disposed in a cylindrical chamber located outside said flow path adjacent said central portion of said flow path, said vortex generator generating a vortex flow in said cylindrical chamber which leaves said cylindrical chamber through a vortex outlet;

a passageway between said central portion of said flow path and said vortex generator;

second electrostatic means, disposed in said central portion of said flow path opposite said passageway, for repelling particulates form the gas stream in said flow path through said passageway into said vortex generator; and third electrostatic means, located in said vortex generator, for diverting particulates entering said vortex generator into said vortex flow, whereby the particulates are exhausted from said vortex generator through said vortex outlet.

28. A device for separating particulates contained in a gas stream, comprising:

means for defining a flow path through which the gas stream flows:

a vortex generator disposed outside said flow path, said vortex generator generating a vortex flow with a second gas stream which leaves said vortex generator through a vortex outlet;

means for inducing particulates form the gas stream in said flow path to pass through a passageway into said vortex generator; and means for diverting particulates entering said vortex generator inwardly into said vortex flow and through said vortex outlet.

* * * * *